US008588627B2

(12) United States Patent
Kawai

(10) Patent No.: US 8,588,627 B2
(45) Date of Patent: Nov. 19, 2013

(54) IMAGE FORMING APPARATUS THAT DETECTS CONSUMABLE SUPPLIES

(75) Inventor: Atsushi Kawai, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 191 days.

(21) Appl. No.: 13/061,901

(22) PCT Filed: Sep. 4, 2009

(86) PCT No.: PCT/JP2009/065499
§ 371 (c)(1),
(2), (4) Date: Mar. 2, 2011

(87) PCT Pub. No.: WO2010/032634
PCT Pub. Date: Mar. 25, 2010

(65) Prior Publication Data

US 2011/0170889 A1 Jul. 14, 2011

(30) Foreign Application Priority Data

Sep. 19, 2008 (JP) ..... 2008-240362

(51) Int. Cl.
*G03G 15/08* (2006.01)

(52) U.S. Cl.
USPC ..... 399/27; 399/30

(58) Field of Classification Search
USPC ..... 399/27, 30, 58, 61–63, 258, 262
See application file for complete search history.

(56) References Cited

U.S. PATENT DOCUMENTS

| | | | | |
|---|---|---|---|---|
| 5,237,372 | A * | 8/1993 | Ishii et al. | 399/30 |
| 5,329,340 | A * | 7/1994 | Fukuchi et al. | 399/254 |
| 5,790,917 | A | 8/1998 | Takura et al. | |
| 6,347,199 | B1 * | 2/2002 | Morihara | 399/27 |
| 7,103,291 | B2 * | 9/2006 | Odani | 399/27 |
| 7,194,212 | B2 | 3/2007 | Kumai et al. | |
| 7,248,805 | B2 * | 7/2007 | Hirota et al. | 399/27 |

FOREIGN PATENT DOCUMENTS

| | | | |
|---|---|---|---|
| DE | 696 25 576 | | 8/2003 |
| DE | 696 36 841 | | 5/2007 |
| EP | 0 772 098 | | 5/1997 |
| EP | 1 265 111 | | 12/2002 |
| FR | 2 740 566 | | 4/1997 |
| IT | 96730736 | | 4/1998 |
| JP | 63298372 | A * | 12/1988 |
| JP | 02073276 | A * | 3/1990 |
| JP | 04336567 | A * | 11/1992 |

(Continued)

OTHER PUBLICATIONS

International Search Report mailed Dec. 1, 2009, direcgted to counterpart International Application No. PCT/JP2009/065499; 4 pages.

(Continued)

*Primary Examiner* — Robert Beatty
(74) *Attorney, Agent, or Firm* — Morrison & Foerster LLP

(57) ABSTRACT

In the image forming apparatus including a developing device that develops an electrostatic latent image on an image carrying member by using toner, a first toner empty stop condition and a second toner empty stop condition for prohibiting printing because of a lack of the remaining amount in the toner are provided. The first toner empty stop condition and the second toner empty stop condition are switched in response to the state of the device.

5 Claims, 9 Drawing Sheets

(56) References Cited

FOREIGN PATENT DOCUMENTS

| | | | | |
|---|---|---|---|---|
| JP | 9-127781 | | | 5/1997 |
| JP | 11295975 | A | * | 10/1999 |
| JP | 2001-166583 | | | 6/2001 |
| JP | 2002-268476 | | | 9/2002 |
| JP | 2003-228227 | | | 8/2003 |
| JP | 2004-13029 | | | 1/2004 |
| JP | 2004013029 | A | * | 1/2004 |
| JP | 2004-45547 | | | 2/2004 |
| JP | 2004-118218 | | | 4/2004 |
| JP | 2005-84072 | | | 3/2005 |
| JP | 2005-326729 | | | 11/2005 |
| JP | 2007-121910 | | | 5/2007 |
| JP | 2009-137202 | | | 6/2009 |

OTHER PUBLICATIONS

Japanese Notification of Reason for Refusal mailed Nov. 17, 2009, directed to counterpart Japanese Patent Application No. 2008-240362; 11 pages.

* cited by examiner

IMAGE FORMING APPARATUS THAT DETECTS CONSUMABLE SUPPLIES

REFERENCE TO RELATED APPLICATIONS

This application is a national stage application under 35 USC 371 of International Application No. PCT/JP2009/065499, filed Sep. 4, 2009, which claims the priority of Japanese Application No. 2008-240362, filed Sep. 19, 2008, the contents of which prior applications are incorporated herein by reference.

FIELD OF THE INVENTION

The present invention relates to an image forming apparatus of an electro photographic system such as a copy machine, a printer, and a facsimile apparatus, particularly, relates to an image forming apparatus that stops a printing detecting a low level of remaining amount in consumable supplies to allow a user to carry out replacement of the consumable supplies.

BACKGROUND OF THE INVENTION

In the image forming apparatus of the electro photographic system, an electrostatic latent image formed on an image carrying member is actualized with a toner by a developing device to be made into a toner image, the toner image is directly transferred on a recording medium or is transferred on the recording medium via an intermediate transcription member, and finally, this toner image is discharged to the outside together with the recording medium. Therefore, the toner is wasted as the number of printed images is increased. Detecting a toner concentration image transferred on the recording medium or the intermediate transcription member by a toner concentration sensor, if the toner concentration is lowered, the toner is replenished to the developing device from a toner hopper via a sub hopper.

When the toner is consumed, the toner state is changed as follows:

(1) A toner cartridge becomes vacant.

This state is judged by a replenishing amount counter of the toner cartridge.

(2) The sub hopper becomes vacant.

This state is judged by a remaining amount sensor of the sub hopper.

(3) The toner concentration on the recording medium or the intermediate transcription member is lowered.

This state is judged by the toner concentration sensor.

As a toner empty stop condition to prohibit printing due to toner empty, conventionally, there are two conditions, and each of them has a merit and a demerit, respectively.

[Condition 1] Empty Stop Due to Lowering of Toner Concentration (Sub Hopper is Vacant)

It is possible to extend interruption of printing. However, when the toner consumption is much, the toner concentration is lowered beyond the scope of assumption. In addition, upon release of empty, replenishing of the sub hopper does not catch up with the toner consumption caused by printing, and the toner concentration is further lowered, leading to a possibility that a trouble caused by abnormal lowering in the toner concentration is generated. In order to avoid this, it is necessary to delay restart of a job by replenishing the toner by compulsion.

[Condition 2] Empty Stop Due to Empty of Sub Hopper (Toner Concentration is Normal)

It is possible to avoid a risk of lowering of the toner concentration. However, even though there is a possibility of printing yet, a print job is interrupted.

In Patent Document 1, it is proposed to output a detection signal with respect to the remaining amount in a developer in a developer container of a cartridge and a caution signal with respect to the state such that the remaining amount in the developer within the cartridge is enough; the remaining amount in the developer has a quantity so as to affect an image quality; and the remaining amount in the developer damages the image quality or the like. In addition, in Patent Document 2, it is proposed to store a parameter for detecting the toner remaining amount that is different for each color to a non-volatile memory of each cartridge, respectively, and detect the toner remaining amount that is different for each color. However, in any patent document, no condition relating to the toner empty stop is described.

Patent Document 1: JP Laid-Open Patent Publication No. 2002-268476

Patent Document 2: JP Laid-Open Patent Publication No. 2004-45447

SUMMARY OF THE INVENTION

An object of the present invention is to provide a user friendly image forming apparatus that can carry out the toner empty stop at a right time without lowering a concentration of a toner and can maintain an image quality.

In order to solve the problems, a first solution is that in an image forming apparatus comprising a developing device that develops an electrostatic latent image on an image carrying member by using a toner, wherein:

a first toner empty stop condition and a second toner empty stop condition for prohibiting printing because the remaining amount in the toner is vacant are provided;

the first toner empty stop condition and the second toner empty stop condition are switched in response to the state of the device.

In a second solution, the first toner empty stop condition and the second toner empty stop condition are judged by different toner empty stop judgment units, respectively.

In a third solution, the second toner empty stop condition is judged after the first toner empty stop condition is judged.

In a fourth solution, the image forming apparatus further including:

a toner cartridge that contains toner and is replaceably fitted to a body of the image forming apparatus;

a sub hopper that is placed between the toner cartridge and the developing device to deliver the toner of the toner cartridge to the developing device;

a unit that replenishes the toner from the toner cartridge to the sub hopper;

a unit that replenishes the toner from the sub hopper to the developing device;

a sub hopper remaining amount detection unit that detects a toner remaining amount in the sub hopper; and a toner concentration sensor that detects the toner concentration in the developing device; wherein:

the first toner empty stop condition is judged by the sub hopper remaining amount detection unit depending on the fact that the sub hopper is vacant; and the second toner empty stop condition is judged by the toner concentration detection unit after the sub hopper is vacant depending on the fact that the toner concentration in the developing device is not more than a predetermined value.

In a fifth solution, the state of the device when switching the toner empty stop condition between the first toner empty stop condition and the second toner empty stop condition is a color of the toner of the toner cartridge; in the case of the toners of colors of Y, M, and C, the empty stop is judged under the first toner empty stop condition; and in the case of the toner of a color of K, the empty stop is judged under the second toner empty stop condition.

In a sixth solution, the state of the device when switching the toner empty stop condition between the first toner empty stop condition and the second toner empty stop condition is a life of the developing device;

in the case that the life of the developing device is in the initial stage, the empty stop is judged under the second toner empty stop condition; and in the case that the life of the developing device is in the end stage, the empty stop is judged under the first toner empty stop condition.

In a seventh solution, the state of the device when switching the toner empty stop condition between the first toner empty stop condition and the second toner empty stop condition is a charged voltage Vg of the image carrying member or a developing bias voltage Vdc;

in the case that the charged voltage Vg or the developing bias voltage Vdc is larger than a predetermined value, under the first toner empty stop condition, the empty stop is judged; and in the case that the charged voltage Vg or the developing bias voltage Vdc is smaller than a predetermined value, under the second toner empty stop condition, the empty stop is judged.

In an eighth solution, the state of the device when switching the toner empty stop condition between the first toner empty stop condition and the second toner empty stop condition is genuineness and non-genuineness of the toner cartridge;

in the case that the toner cartridge is a genuine one, under the second toner empty stop condition, the empty stop is judged; and in the case that the toner cartridge is a non-genuine one, under the first toner empty stop condition, the empty stop is judged.

According to the present invention, since the prohibition of printing condition due to the toner empty is changed depending on the state of the device, it is possible to carry out the toner empty stop at a right time without lowering a concentration of a toner and maintain an image quality, and further, making the apparatus user friendly.

DETAILED DESCRIPTION OF THE INVENTION

Hereinafter, embodiments according to the present invention will be described with reference to the drawings.

Figure 1:
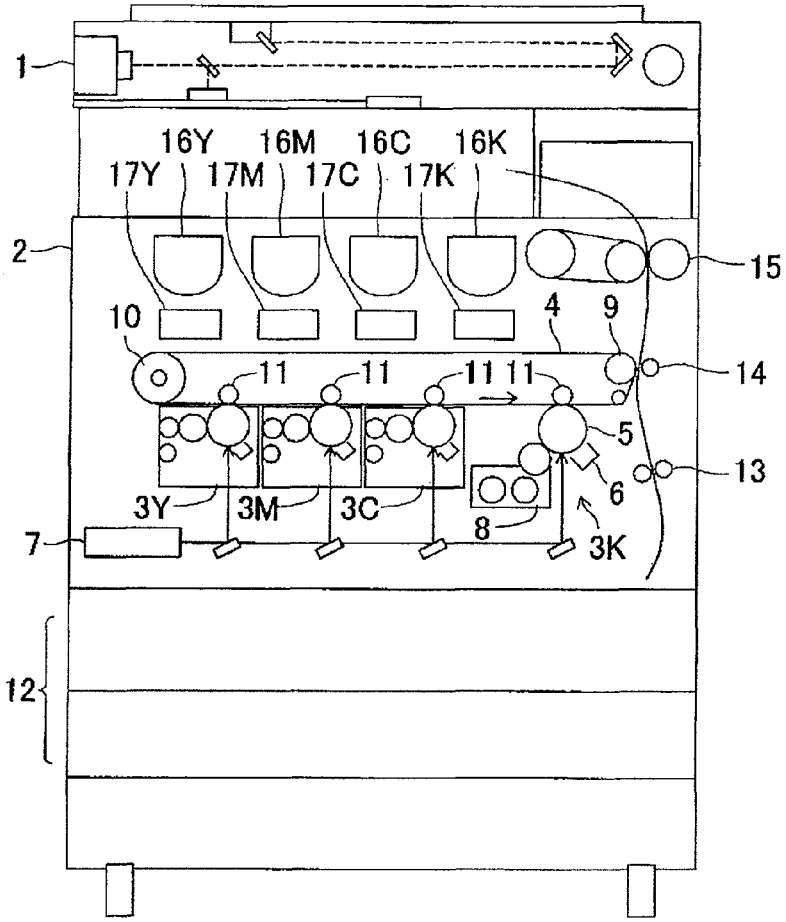
FIG. 1 is a schematic structure diagram of an image forming apparatus according to the present embodiment.

FIG. 1 is a schematic structure diagram of a color image forming apparatus according to the present invention. The image forming apparatus is formed by an image reading part 1 and an image forming part 2. The image reading part 1 has a publicly-known configuration that scan a script image to convert it into the image data for reading. In the image forming part 2, image forming units 3Y, 3M, 3C, and 3K (they are generically named as an image forming unit 3) that form toner images of respective colors, Y (yellow), M (magenta), C (cyan), and K (black) are arranged along an intermediate transfer belt 4.

Each of the image forming units 3Y, 3M, 3C, and 3K is provided with an image carrying member 5 formed by a photo conductor drum that is arranged in adjacent to the intermediate transfer belt 4, a charging device 6 that uniformly charges the surface of the image carrying member 5 to form a potential, an exposure device 7 that exposes the surface of the image carrying member 5 on the basis of an image signal to form an electrostatic latent image, and an developing device 8 that actualizes the electrostatic latent image by attaching the toner to the electrostatic latent image on the image carrying member 5 to form toner images of respective colors.

The intermediate transfer belt 4 is stretched between a driving roller 9 and a driven roller 10 and can run in an arrow direction. In the inside of the intermediate transfer belt 4, primary transcription rollers 11 are arranged so as to be opposed to the image carrying members 5 of respective image forming units 3Y, 3M, 3C, and 3K via the intermediate transfer belt 4, which form color toner images by transcribing the toner image on the image carrying members 5. A secondary transcription roller 14 is arranged so as to be opposed to the driving roller 9 of the intermediate transfer belt 4 via the intermediate transfer belt 4, which transfers a color toner image on the intermediate transfer belt 4 to a sheet P to be fed from a paper feeding unit 12 via a timing roller 13. On a down stream side in a direction for feeding a sheet of the secondary transcription roller 14, a fixing device 15 that fixes the color toner image transferred by the secondary transcription roller 14 is arranged.

Above the intermediate transfer belt 4, toner cartridges 16Y, 16M, 16C, and 16K (they are generically named as a toner cartridge 16) and sub hoppers 17Y, 17M, 17C, and 17K (they are generically named as a sub hopper 17) are arranged corresponding to the respective image forming units 3Y, 3M, 3C, and 3K.

Figure 2:
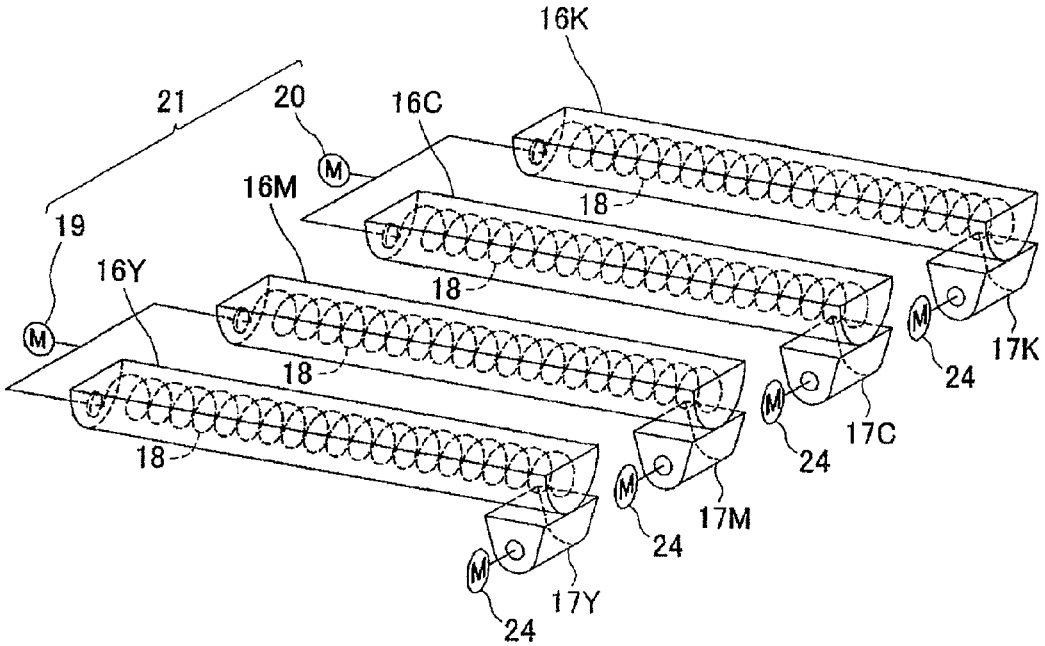
FIG. 2 is a schematic perspective view of a toner cartridge and a sub hopper.

As shown in FIG. 2, the toner cartridge 16 has spiral springs 18 arranged in its inside so as to be capable of being rotatably driven and contains toners of respective colors therein. The spiral springs 18 of the toner cartridges 16Y and 16M for Y and M are rotatably driven by a first stepping motor 19 via a one-way clutch (not illustrated), and the spiral springs 18 of the toner cartridges 16C and 16K for C and K are rotatably driven by a second stepping motor 20 via a one-way clutch (not illustrated). If the first stepping motor 19 is normally rotated, the spiral spring 18 of the toner cartridge 16Y for Y is rotated, and then, the spiral spring 18 of the toner cartridge M for M idly runs. If the first stepping motor 19 is inversely rotated, the spiral spring 18 of the toner cartridge 16Y for Y idly runs, and the spiral spring 18 of the toner cartridge M for M is rotated. The same is applied to the second stepping motor 20. In this way, by changing the first stepping motor 19 and the second stepping motor 20 between normal rotation and inverse rotation (hereinafter, they are generically named as a cartridge motor 21) to rotate the spiral springs 18 of the toner cartridges 16Y, 16M, 16C, and 16K for Y, M, C, and K, the toner within the toner cartridge 16 is moved in an arrow direction to be capable of being replenished to the sub hopper 17.

Figure 3:
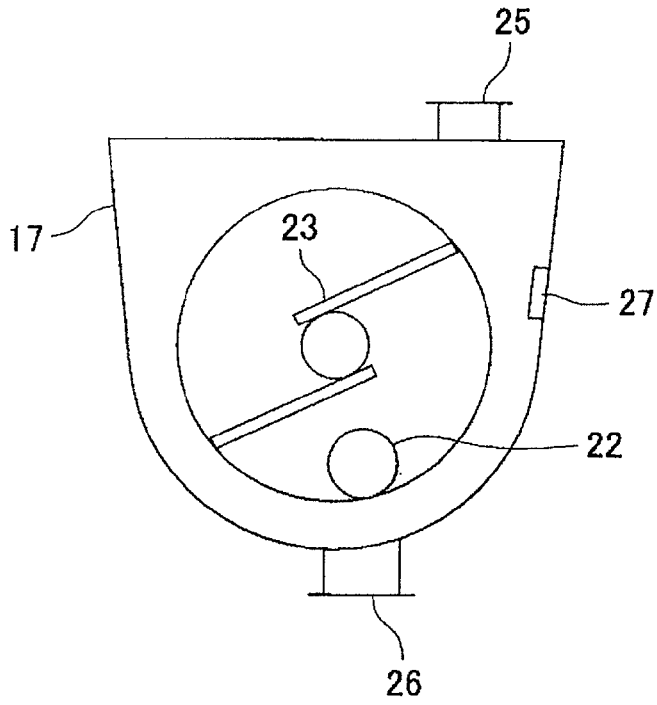
FIG. 3 is a schematic structure diagram of the sub hopper.

As shown in FIG. 3, the sub hopper 17 has a spiral roller 22 and scraping paddles 23 provided in its inside, and they are configured so as to be rotated in conjunction with each other by a stepping motor 24 (hereinafter, referred to as a sub hopper motor). Above the sub hopper 17, an inlet 25 for accepting the toner from the toner cartridges 16Y, 16M, 16C, and 16K is placed, and at the bottom of the sub hopper 17, an outlet 26 for replenishing the toner to the developing device 8 of each color via a path (not illustrated) is placed. In the sub hopper 17, a sub hopper remaining amount sensor 27 is placed, and the sub hopper 17 is configured so that the toner is scraped toward the sub hopper remaining amount sensor 27 by the scraping paddles 23. The sub hopper remaining amount sensor 27 is a piezo sensor and, the sub hopper remaining amount sensor 27 detects a toner empty when it is not subjected to a pressure from the toner. The toner which is replenished from the toner cartridges 16Y, 16M, 16C, and 16K to the sub hopper 17 can be replenished to the developing device 8 by driving the sub hopper motor 24.

Figure 4:
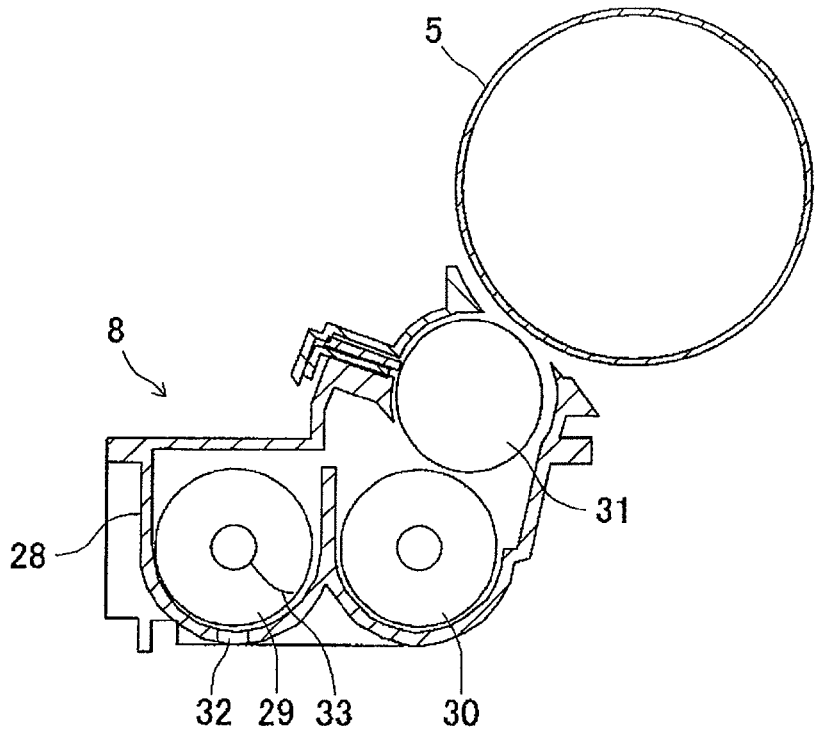
FIG. 4 is a structure diagram of a developing device.

As shown in FIG. 4, the developing device 8 has an agitating screw 29 and a conveyance screw 30 that convey the developer to the inside of a developer bottle 28 while agitating the developer, and a developer roller 31 that delivers the developer to be conveyed by the conveyance screw 30 to the image carrying members. Within the developer bottle 28, a toner concentration sensor 32 of a binary developer that is composed of a toner and a carrier is provided. The developer around the toner concentration sensor 32 is agitated by a Mylar sheet 33 that is attached to the agitating screw 29, a new developer flows around the toner concentration sensor 32 every time the agitating screw 29 is rotated one revolution (one ripple), causing a replacement of the developer. The toner concentration sensor 32 reads a magnetic permeability of iron contained in the carrier to output an analog signal. Accordingly, if an AD converted value (a resolution 10 bit) of the analog signal is large, the toner concentration is low.

Figure 5:
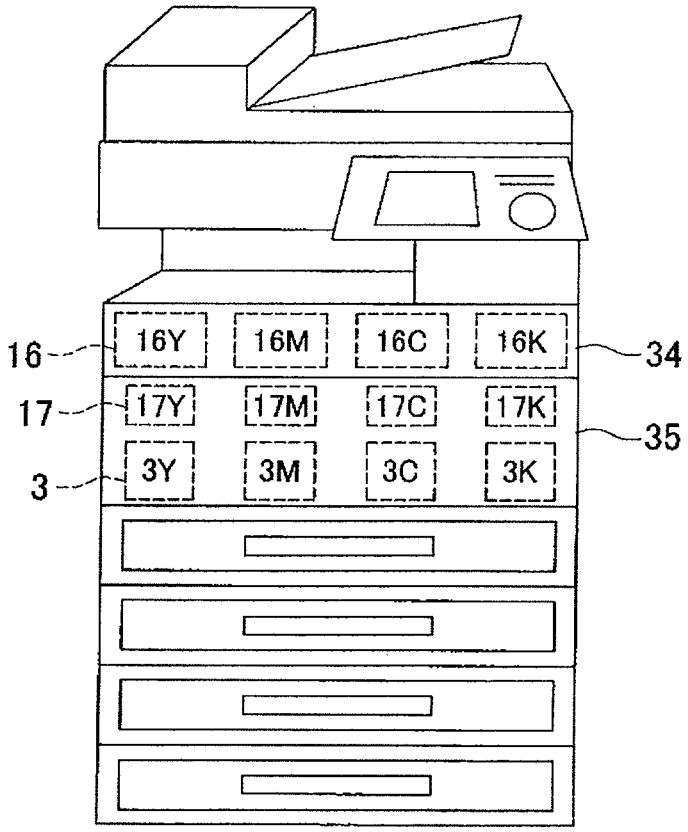
FIG. 5 is a front view showing the arrangement of a door of the image forming apparatus.

FIG. 5 indicates a door in front of the image forming apparatus. A toner replenishing door 34 that is opened and closed when replacing the toner cartridges 16Y, 16M, 16C, and 16K is provided above the image forming apparatus, and a front door 35 that is opened and closed when checking the image forming units 3Y, 3M, 3C, and 3K is provided below the toner replenishing door 34. The toner replenishing door 34 intends to replace the cartridges 16Y, 16M, 16C, and 16K, so that, even if they are opened and closed during printing, the print operation is not stopped.

Figure 6:
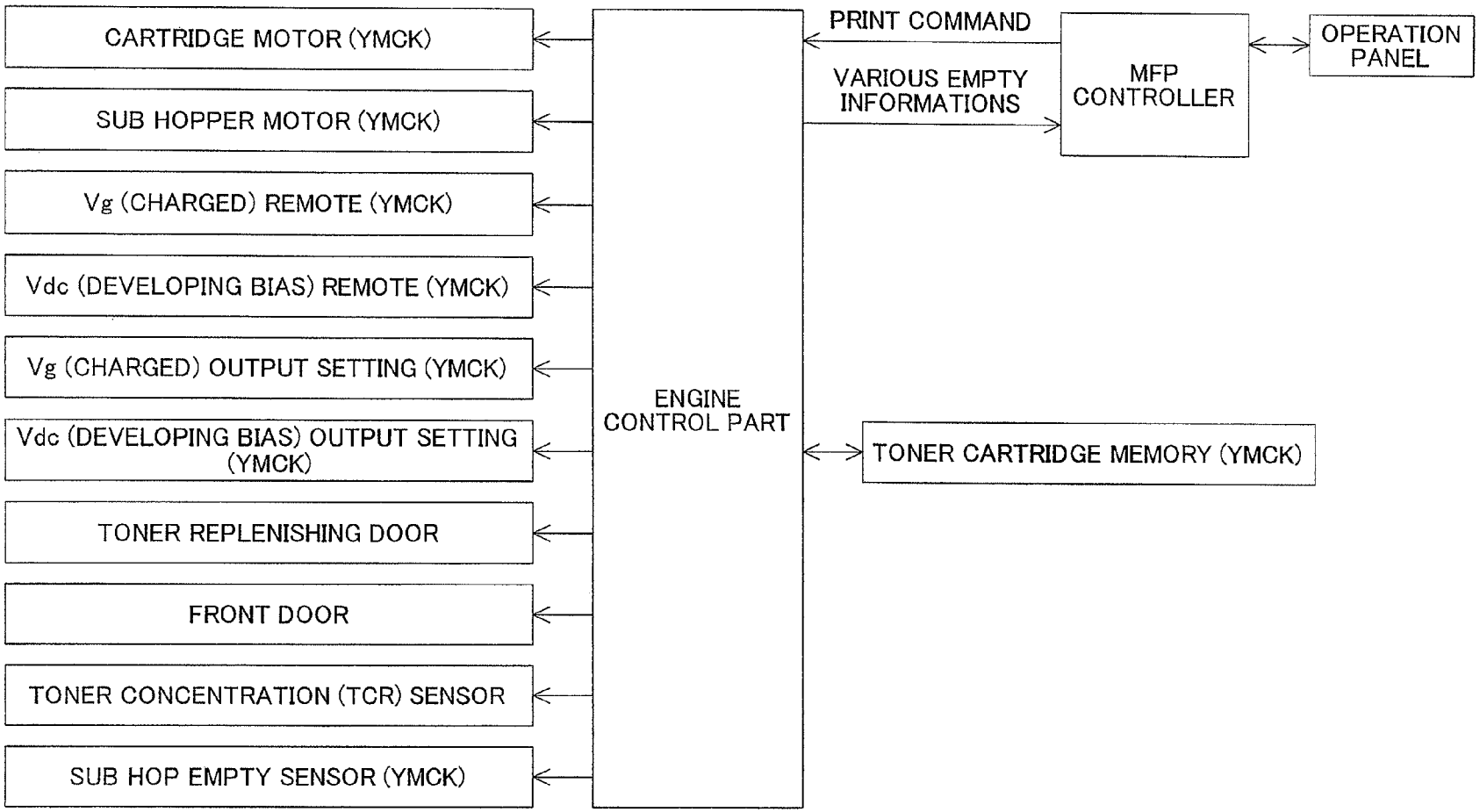
FIG. 6 is a block diagram of toner replenishing control of the image forming apparatus.

FIG. 6 shows a block diagram of a control system of the image forming apparatus. The control system of the image forming apparatus is configured by an engine control part 41 to control each unit, an MFP controller 42 to control this engine control part 41, and an operation panel 43. As for the toner replenishing control, as input means, the toner replenishing door 34, the front door 35, the toner concentration sensor 32, the sub hopper remaining amount sensor 27, and a toner cartridge memory 44 are connected to the engine control part 41; and as output means, the cartridge motor 21, the sub hopper motor 24, a Vg/Vdc remote, a Vg/Vdc output setting, and the toner cartridge memory 44 are connected to the engine control part 41. The engine control part 41 and the MFP controller 42 are connected with each other through communication means. From the MFP controller 42, a print command is transmitted, and from the engine control part 41, various kinds of empty information and the like are transmitted. The operation panel 43 is connected to the MFP controller 42 through communication to receive the input of the user and notify the user of various kinds of information.

Next, the operation of the image formation according to the image forming apparatus composed of the above-described configuration has been publicly known, and this operation is not directly related to the present invention per se, so that the explanation thereof is herein omitted and the toner replenishing operation will be described as follows:

1. Toner Replenishing Control

The toner replenishing control is divided into two main controls of the toner replenishing control from the toner cartridge 16 to the sub hopper 17, and the toner replenishing control from the sub hopper 17 to the developing device 8.

1.1 Toner Replenishing Control from Cartridge to Sub Hopper

In the toner replenishing control from the toner cartridge 16 to the sub hopper 17, due to the output of the sub hopper remaining amount sensor 27 of the sub hopper 17, the toner is replenished from the cartridge 16 to the sub hopper 17.

In driving of the sub hopper motor 24, detecting the sub hopper remaining amount sensor 27 in the sub hopper 17 with a period of 200 ms, and driving the cartridge motor 21 depending on its detection result, the toner is replenished from the toner cartridge 16 to the sub hopper 17.

1.2 Toner Replenishing Control from Sub Hopper to Developing Device

In the toner replenishing control from the sub hopper 17 to the developing device 8, the toner is replenished from the sub hopper 17 to the developing device 8 so that the construction of the toner in the developing device 8 (the ratio of the toner with respect to the developer made of the toner and the carrier) becomes a target ratio.

This toner replenishing control is divided into the replenishing amount decision control and the replenishing operation control.

1.2.1 Replenishing Amount Decision Control

Reading an output voltage in the toner concentration sensor 32 within the developing device 8 during rotation of the developer roller 31, the toner concentration is calculated from a lookup table of the toner concentration with respect to this voltage. From the predetermined target toner concentration and the calculated toner concentration, the toner replenishing amount is decided from the lookup table.

1.2.2 Replenishing Operation Control

Driving the sub hopper motor 24 of the sub hopper 17 for each color by the toner replenishing amount that is decided by the replenishing amount decision control, the toner is replenished to the inside of the developing device 8. The replenishing operation control includes the normal toner replenishing control during the printing operation and the compulsory toner replenishing control to be carried out by interruption of printing. In the normal toner replenishing control, the longest time capable of replenishing the toner is rate-controlled by the operational time of the developing device 8 for printing, so that it is not possible to raise the toner concentration to the target toner concentration during printing According to the compulsory toner replenishing control, the toner replenishing mechanism and the developing device 8 are driven until the toner concentration reaches the target toner concentration.

2. Toner Empty Detection Control

The toner empty state includes four states, namely, "normal", "nearly empty", "sub hopper empty", and "toner empty".

The "normal" is the state other than the following empty states, and this means the state that the toner is sufficiently filled in the toner cartridge 16 and the sub hopper 17.

The "nearly empty" means the state that the toner within the toner cartridge 16 is less although the toner is filled in the sub hopper 17.

The "sub hopper empty" means the state that the toners in the sub hopper 17 and the toner cartridge 16 are empty.

The "toner empty" means the state that the toner concentration is further lowered and this makes it impossible to continue printing. This is the state that the toner in the sub hoper 17 is lost further from the "sub hop empty", the toner in the developing device 8 is also consumed, and the toner concentration is lowered.

Figure 7:
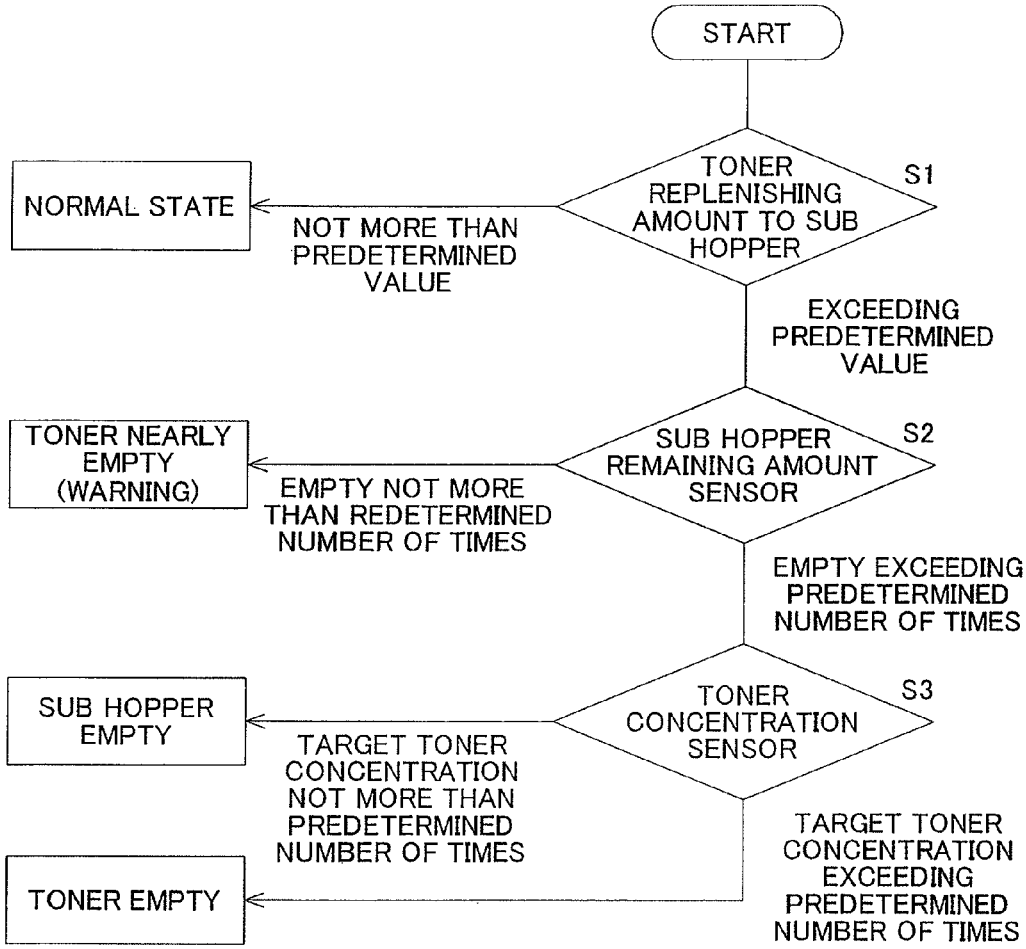
FIG. 7 is a flow chart of toner empty detection control.

FIG. 7 shows the toner empty detection control.

In step S1, upon driving of the cartridge motor 21, the rotation amount of the cartridge motor 21 is accumulated to estimate the toner replenishing amount that is replenished from the toner cartridge 16 to the sub hopper 17. If the toner replenishing amount is not more than a predetermined value, the toner empty state is defined as the "normal" state, and if the toner replenishing amount exceeds a predetermined value, the procedure moves to step S2.

In step S2, it is detected whether or not the empty is detected in succession in the predetermined number of times by means of the sub hopper remaining amount sensor in the sub hopper 17. If the detection of the empty is not more than the predetermined number of times, the toner empty state is defined as the "nearly empty" state such that the toner remaining amount in the toner cartridge 16 is almost empty, and if the toner replenishing amount is detected exceeding the predetermined number of times, the procedure moves to step S3.

In step S3, it is detected by the sub hopper remaining amount sensor 32 whether or not the toner concentration in the developing device 8 being the value of the target toner concentration −1% is detected in thirty times in succession. If the number of times for detection of the target toner concentration is not more than 30, the toner empty state is defined as the "sub hopper empty", and if the number of times for detection of the target toner concentration exceeds 30, the toner empty state is defined as the "toner empty".

In the case of "nearly empty", a warning that "toner is to be empty soon" is displayed on the operation panel 43.

In the case of "sub hopper empty" or "toner empty", a full warning that "the toner is lost" is displayed on the operation panel 43 and the printing is prohibited.

When the toner empty state is "normal" and "nearly empty", the user is capable of replacing the toner cartridge 16 despite the state of ready and waiting.

When the toner state is in the "sub hopper empty" and the "toner empty", the user can replace the toner cartridge 16 during wait, or during print interruption due to printing prohibition during the printing.

3. Printing Prohibition Control in Toner Empty

The state of the device to prohibit the printing because of the toner empty includes four states as follows:

(1) Colors of toner (2) Life of developing device (3) Vg/Dc (4) Genuineness/non-genuineness of cartridge Hereinafter, they will be explained in sequence.

3.1 Printing Prohibition Control in Toner Empty Due to Color of Toner

In the case of the toners of colors Y, M, and C, by means of the sub hopper remaining amount sensor 27 that are a first toner empty stop judgment unit, the toner empty stop is judged. If the concentrations of the toners Y, M, and C are lowered, the concentration of the color image becomes light and a color shade of a photographic image is changed. Therefore, it is preferable that the toner empty stop is early judged by the sub hopper remaining amount sensor 27 located on the upstream side of the developing device 8.

In the case of the toner of a color K, the toner empty stop is judged by the toner concentration sensor 32 that is a second toner empty stop judgment unit. This reason is as follows. Small amount of lowering of the toner concentration can be allowed because many of the images according to the toner of the color K are character images. In addition, in the case of the toner empty in the toner of the color K, it is preferable that prohibition of printing is delayed as much as possible since not only printing of black and white images but also printing of color images is prohibited.

Figure 8:
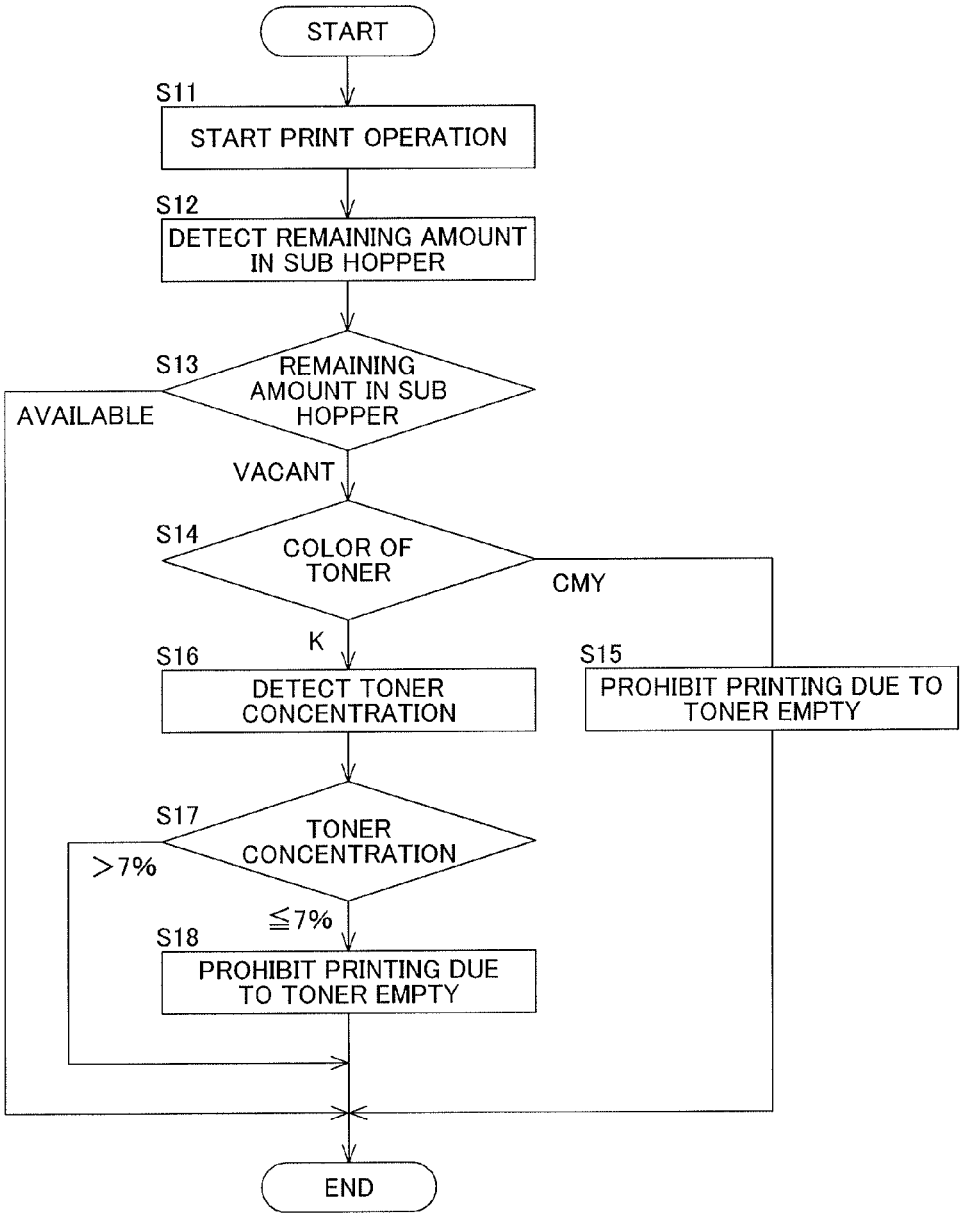
FIG. 8 is a flow chart of printing prohibition control upon a toner empty due to a color of a toner.

FIG. 8 is a flow chart showing the operation of changing the conditions of the printing prohibition due to the toner empty depending on a color of the toner.

In step S11, the print operation is started; and in step S12, the output of the sub hopper remaining amount sensor 27 is read. If the remaining amount in the sub hopper is available in step S13, the flow is ended, and if the remaining amount in the sub hopper is vacant, in step S14, the color of the toner is judged. If the color of the toner is Y, M, and C, in step S15, the printing is prohibited by the toner empty. If the color of the toner is K, in step S16, the output of the toner concentration sensor 32 is read. If the toner concentration exceeds 7%, the flow is ended, and if the toner concentration is not more than 7%, in step S17, printing is prohibited due to the toner empty in step S17.

3.2 Printing Prohibition Control in Toner Empty Due to Life of Developing Device The life of the developing device 8 is to be decided by the rotational agitation time of the agitating screw 29. This is because, if the rotational agitation time is increased, the developer made of the toner and the carrier (particularly, the carrier) is deteriorated, so that an ability to charge the toner of the carrier is lowered. Therefore, in the image forming apparatus, a life counter for counting the life of the developing device 8 is provided.

In the case that the life value of the developing device 8 is in an initial stage, the toner empty stop is judged by the toner concentration sensor 32 that is a second toner empty stop judgment unit. Normally, the toner concentration is controlled to be a concentration with which charging of the toner has the highest stability. In the initial stage, to delay the prohibition of printing has no problem because variation in the toner concentration is small.

In the case that the life value of the developing device 8 is in an end stage, the toner empty stop is judged by the sub hopper remaining amount sensor 27 that is a first toner empty stop judgment unit. In the end stage, variation in the toner concentration easily leads to fog and adhesion of the carrier. Therefore, in order to prevent change in the toner concentration as much as possible, the toner empty stop is judged early by the sub hopper remaining amount sensor 27 located on the upstream side of the developing device.

Figure 9:
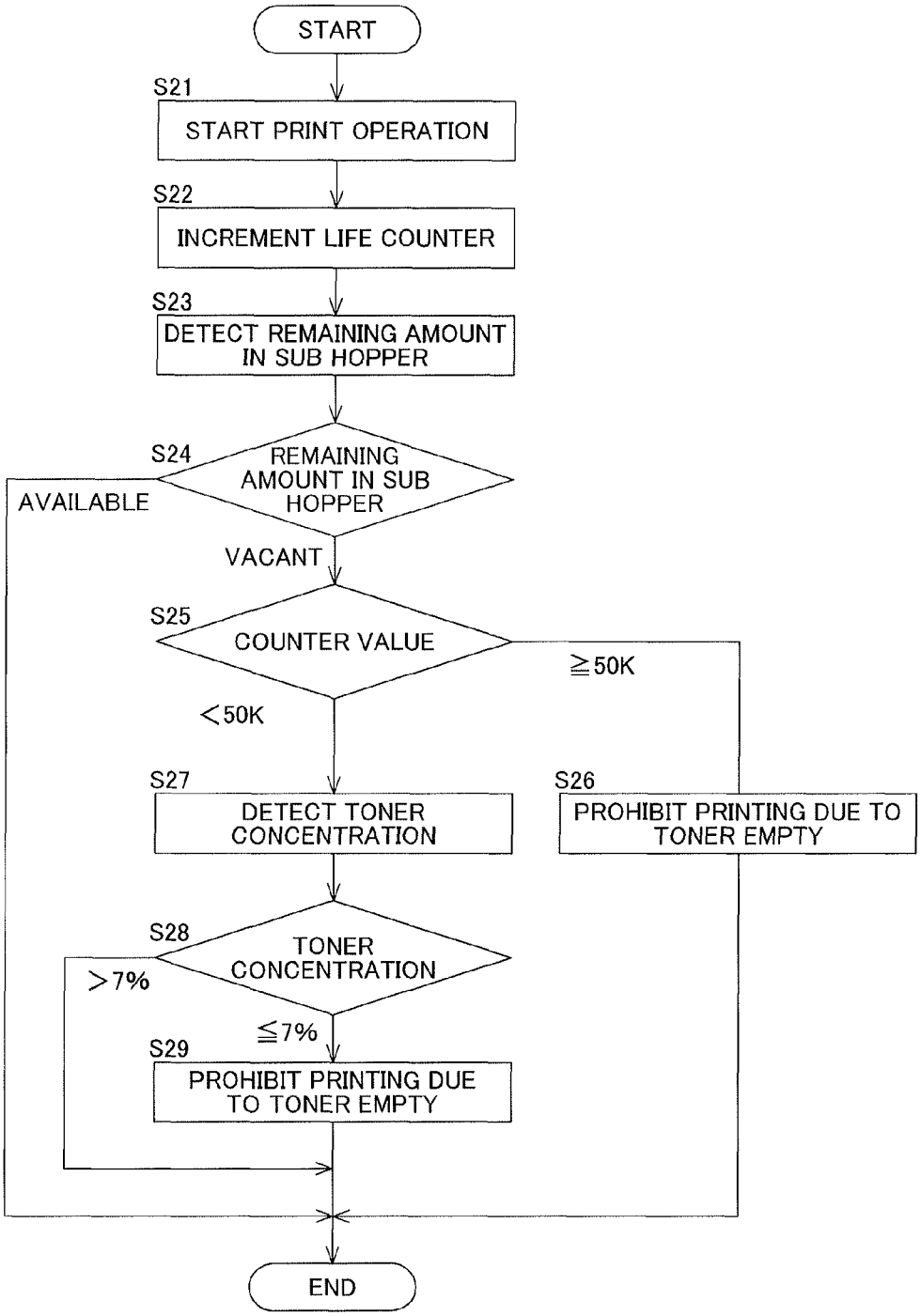
FIG. 9 is a flow chart of printing prohibition control upon the toner empty due to a life of the developing device.

FIG. 9 is a flow chart showing the operation of changing the condition of the printing prohibition due to the toner empty depending on the life of the developing device 8.

In step S21, the print operation is started, and in step S22, the life counter is incremented. The life of the developing device 8 is decided by the agitation time as described above, however, it is assumed that the life of the developing device 8 is decided by the number of sheet to be printed, and the life counter is incremented for each sheet. In step S23, the output of the sub hopper remaining amount sensor 27 is read. In step S24, if the remaining amount in the sub hopper is available, the flow is ended, and if the remaining amount in the sub hopper is vacant, the count value of the life counter is judged in step S25. If the count value is not more than 50K, the printing is prohibited by the toner empty in step S26. If the count value is less than 50K, in step S27, the output of the toner concentration detection sensor is read. If the toner concentration exceeds 7%, the flow is ended, and if the toner concentration is not more than 7%, in step S29, the printing is prohibited by the toner empty.

3.3 Printing Prohibition Control in Toner Empty Due to Vg/Vdc

It is necessary for a charged voltage (Vg) of the image carrying member 5 formed by the photo conductor drum and a developing bias voltage (Vdc) of the developer roller 31 to increase when the life of the developing device 8 is near the end as well as when the environment of usage and the LD light volume are deteriorated. For example, under a low temperature and a low degree of humidity, the toner charged amount is increased and a developing efficiency is lowered. Therefore, depending on the image stabilization control, the charged voltage (Vg) and the developing bias voltage (Vdc) are increased. As a result, when Vg and Vdc are high, lowering of the toner concentration should be prevented, which become a factor for further increasing Vg and Vdc.

That is to say, in the case that Vg and Vdc are increased than predetermined values, by means of the sub hopper remaining amount sensor 27 that is the first toner empty stop judgment unit, the toner empty stop is judged. When Vg and Vdc are high, in order to prevent lowering of the toner concentration, it is preferable that the toner empty stop is early judged by the sub hopper remaining amount sensor 27 located on the upstream side of the developing device.

When Vg and Vdc are lower than predetermined values, the toner empty stop is judged by the toner concentration sensor 32 that is the second toner empty stop judgment unit. Change in the toner concentration can be allowed to some extent, so that there is no problem in delaying in prohibition of printing.

Figure 10:
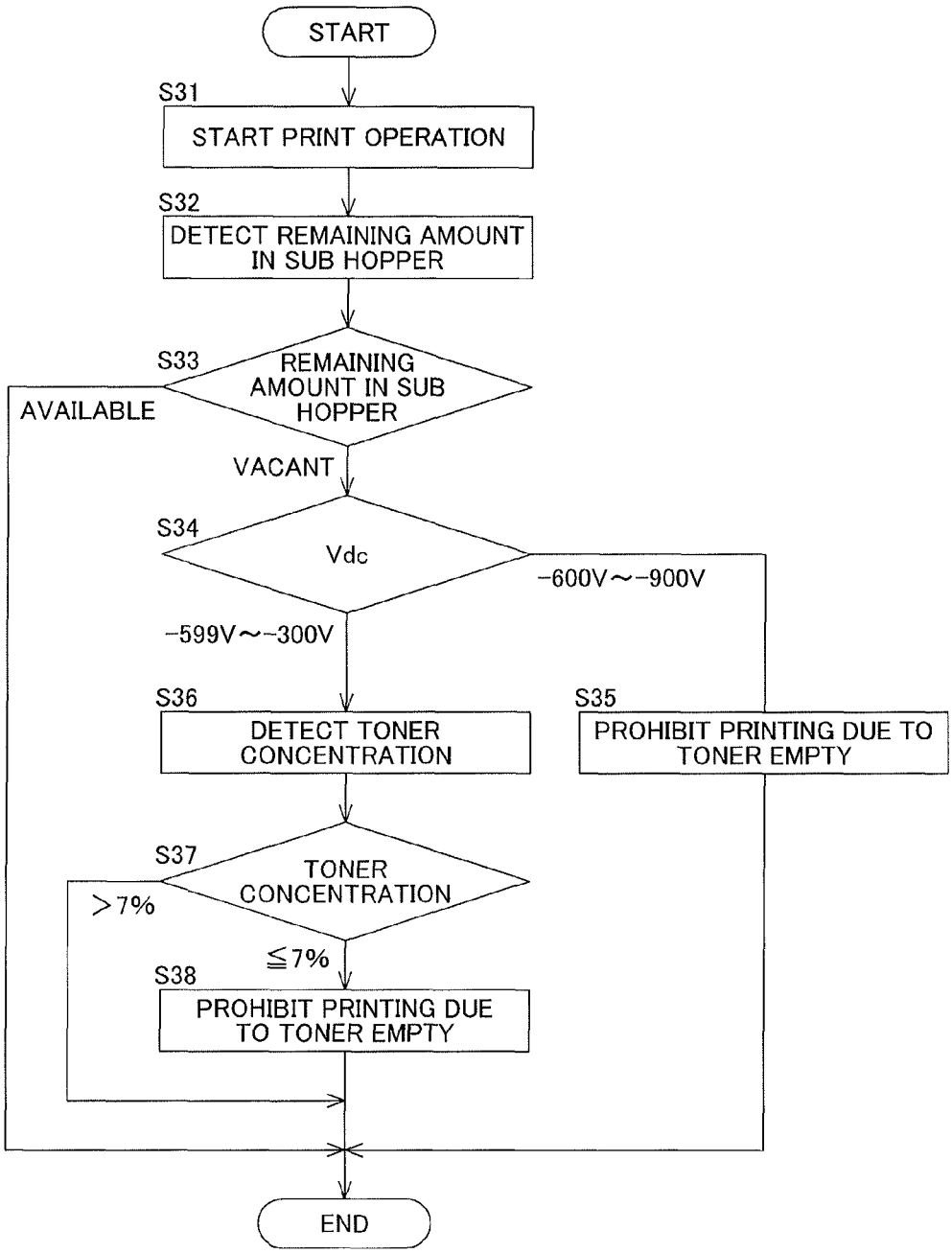
FIG. 10 is a flow chart of printing prohibition control upon the toner empty due to Vg/Vdc.

FIG. 10 is a flow chart showing the operation of changing the conditions of the printing prohibition by the toner empty by Vdc.

In step S31, the print operation is started, and in step S32, the output of the sub hopper remaining amount sensor 27 is read. If the remaining amount in the sub hopper is available in step S33, the flow is ended, and if the remaining amount in the sub hopper is vacant, in step S34, the Vdc is judged. If Vdc is in the range of −600 V to −900 V, in step S35, printing is prohibited by the toner empty. If Vdc is in the range of −599 V to −300V, in step S36, the output of the toner concentration sensor 32 is read. If the toner concentration exceeds 7%, the flow is ended, and if the toner concentration is not more than 7%, in step S37, the printing is prohibited by the toner empty.

3.4 Printing Prohibition Control in Toner Empty Due to Genuineness/Non-Genuineness of Cartridge In the case that the toner cartridge 16 is a genuine one, the toner empty stop is judged by the toner concentration sensor 32 that is the second toner empty stop judgment unit. The genuine toner cartridge 16 has the toner with an excellent quality and can allow change in the toner concentration to some extent, so that there is no problem in delaying in prohibition of printing.

In the case that the toner cartridge 16 is a non-genuine one, the toner empty stop is judged by the sub hopper remaining amount sensor 27 that is the first toner empty stop judgment unit. When the toner cartridge 16 is a non-genuine one, the quality of the toner is poorer than that of the genuine one in many cases. Therefore, in order to prevent lowering of the toner concentration, it is preferable that the toner empty stop is early judged by the sub hopper remaining amount sensor 27 located on the upstream side of the developing device.

Figure 11:
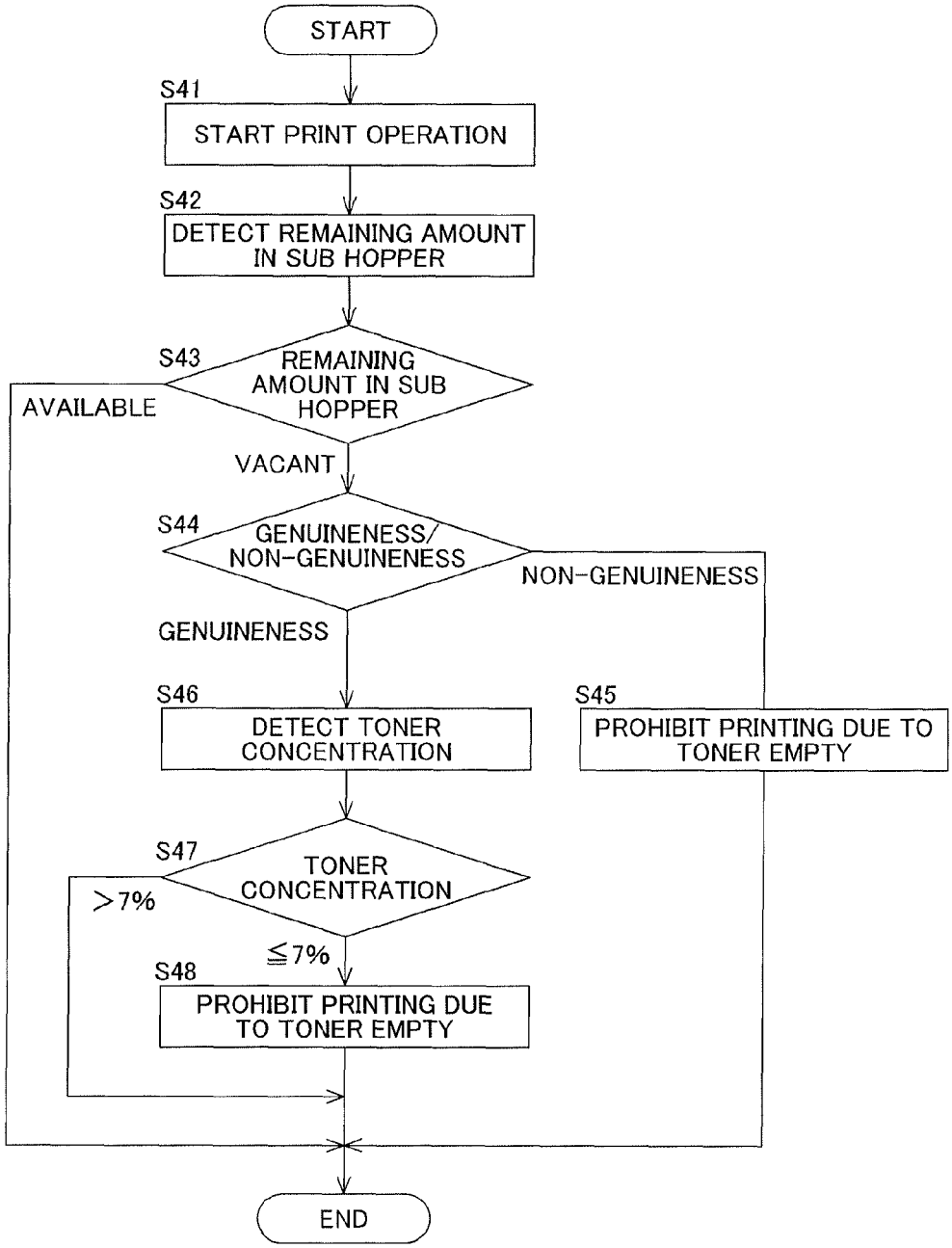
FIG. 11 is a flow chart of printing prohibition control upon the toner empty due to genuineness/non-genuineness of a toner cartridge.

FIG. 11 is a flow chart showing the operation of changing the conditions of the printing prohibition due to the toner empty due to genuineness/non-genuineness of the toner cartridge 16.

In step S41, the print operation is started, and in step S42, the output of the sub hopper remaining amount sensor 27 is read. In step S43, if the remaining amount in the sub hopper is available, the flow is ended, and if the remaining amount in the sub hopper is vacant, it is judged if the toner cartridge 16 is genuine or non-genuine in step S44. Whether or not the toner cartridge is a genuine one or a non-genuine one can be judged by reading the information of the toner cartridge memory 44 provided in the cartridge 16. If the toner cartridge is a non-genuine one, in step S35, the printing is prohibited due to the toner empty. If the toner cartridge is a genuine one, in step S36, the output of the toner concentration detection sensor is read. If the toner concentration exceeds 7%, the flow is ended, and if the toner concentration is not more than 7%, the printing is prohibited due to the toner empty in step S37.

The invention claimed is:

1. An image forming apparatus comprising:

an image carrying member;

a developing device that develops an electrostatic latent image on the image carrying member by using a toner;

a controller that switches between a first toner empty stop condition and a second toner empty stop condition are in response to the state of the device, wherein said first toner empty stop condition and said second toner empty stop condition for prohibiting printing because of a lack of the remaining amount in the toner are provided;

a toner cartridge that contains toner and is replaceably fitted to a body of the image forming apparatus;

a sub hopper that is placed between said toner cartridge and said developing device to deliver the toner of said toner cartridge to said developing device;

a first unit that replenishes the toner from said toner cartridge to said sub hopper;

a second unit that replenishes the toner from said sub hopper to said developing device;

a sub hopper remaining amount detection unit that detects a toner remaining amount in said sub hopper; and a toner concentration detection unit that detects the toner concentration in said developing device;

wherein:

said first toner empty stop condition is judged by said sub hopper remaining amount detection unit depending on the fact that said sub hopper is vacant; and said second toner empty stop condition is judged by said toner concentration detection unit after said sub hopper is vacant depending on the fact that the toner concentration in said developing device is not more than a predetermined value.

2. An image forming apparatus comprising:

an image carrying member;

a developing device that develops an electrostatic latent image on the image carrying member by using a toner;

a controller that switches between a first toner empty stop condition and a second toner empty stop condition are in response to the state of the device, wherein said first toner empty stop condition and said second toner empty stop condition for prohibiting printing because of a lack of the remaining amount in the toner are provided;

the state of the device when switching the toner empty stop condition between said first toner empty stop condition and said second toner empty stop condition is a color of the toner of a toner cartridge that contains toner and is replaceably fitted to a body of the image forming apparatus; and wherein in the case of the toners of colors of Y, M, and C, the empty stop is judged under said first toner empty stop condition; and in the case of the toner of a color of K, the empty stop is judged under said second toner empty stop condition.

3. An image forming apparatus comprising:

an image carrying member;

a developing device that develops an electrostatic latent image on the image carrying member by using a toner;

a controller that switches between a first toner empty stop condition and a second toner empty stop condition are in response to the state of the device, wherein said first toner empty stop condition and said second toner empty stop condition for prohibiting printing because of a lack of the remaining amount in the toner are provided;

the state of the device when switching the toner empty stop condition between said first toner empty stop condition and said second toner empty stop condition is a life of said developing device; and wherein in the case that the life of said developing device is in the initial stage, the empty stop is judged under said second toner empty stop condition; and in the case that the life of said developing device is in the end stage, the empty stop is judged under said first toner empty stop condition.

4. An image forming apparatus comprising:

an image carrying member;

a developing device that develops an electrostatic latent image on the image carrying member by using a toner;

a controller that switches between a first toner empty stop condition and a second toner empty stop condition are in response to the state of the device, wherein said first toner empty stop condition and said second toner empty stop condition for prohibiting printing because of a lack of the remaining amount in the toner are provided;

the state of the device when switching the toner empty stop condition between said first toner empty stop condition and said second toner empty stop condition is a charged voltage Vg of said image carrying member or a developing bias voltage Vdc; and wherein in the case that said charged voltage Vg or said developing bias voltage Vdc is larger than a predetermined value, under said first toner empty stop condition, the empty stop is judged; and in the case that said charged voltage Vg or said developing bias voltage Vdc is smaller than a predetermined value, under said second toner empty stop condition, the empty stop is judged.

5. An image forming apparatus comprising:

an image carrying member;

a developing device that develops an electrostatic latent image on the image carrying member by using a toner;

a controller that switches between a first toner empty stop condition and a second toner empty stop condition are in response to the state of the device, wherein said first toner empty stop condition and said second toner empty stop condition for prohibiting printing because of a lack of the remaining amount in the toner are provided;

the state of the device when switching the toner empty stop condition between said first toner empty stop condition and said second toner empty stop condition is genuineness and non-genuineness of a toner cartridge that contains toner and is replaceably fitted to a body of the image forming apparatus; and wherein in the case that said toner cartridge is a genuine one, under said second toner empty stop condition, the empty stop is judged; and in the case that said toner cartridge is a non-genuine one, under said first toner empty stop condition, the empty stop is judged.

* * * * *

UNITED STATES PATENT AND TRADEMARK OFFICE

CERTIFICATE OF CORRECTION

PATENT NO. : 8,588,627 B2
APPLICATION NO. : 13/061901
DATED : November 19, 2013
INVENTOR(S) : Atsushi Kawai It is certified that error appears in the above-identified patent and that said Letters Patent is hereby corrected as shown below:

Title Page:

Item 56 Other Publications delete "International Search Report mailed Dec. 1, 2009, direcgted to counterpart International Application No. PCT/JP2009/065499; 4 pages." and replace with --International Search Report mailed Dec. 1, 2009, directed to counterpart International Application No. PCT/JP2009/065499; 4 pages.--

Signed and Sealed this
Twenty-fifth Day of March, 2014

Michelle K. Lee

Michelle K. Lee
*Deputy Director of the United States Patent and Trademark Office*